US008035289B2

(12) United States Patent
Auday et al.

(10) Patent No.: US 8,035,289 B2
(45) Date of Patent: Oct. 11, 2011

(54) FLAT COPLANAR-DISCHARGE LAMP AND USES OF SAME

(75) Inventors: Guillaume Auday, Bussiere St. Georges (FR); Jingwei Zhang, Massy (FR); Didier Duron, Boulogne Billancourt (FR); Philippe Guillot, Terssac (FR); Thierry Callegari, Toulouse (FR); Philippe Belenguer, Pompertuzat (FR)

(73) Assignee: Saint-Gobain Glass France, Courbevoie (FR)

( * ) Notice: Subject to any disclaimer, the term of this patent is extended or adjusted under 35 U.S.C. 154(b) by 495 days.

(21) Appl. No.: 12/064,516

(22) PCT Filed: Aug. 16, 2006

(86) PCT No.: PCT/FR2006/050801

§ 371 (c)(1),
(2), (4) Date: Sep. 12, 2008

(87) PCT Pub. No.: WO2007/023237

PCT Pub. Date: Mar. 1, 2007

(65) Prior Publication Data

US 2009/0058295 A1 Mar. 5, 2009

(30) Foreign Application Priority Data

Aug. 23, 2005 (FR) ..... 05 52546

(51) Int. Cl.
*H01J 1/62* (2006.01)

(52) U.S. Cl. ..... 313/491; 313/581; 313/494

(58) Field of Classification Search ..... 313/422, 313/634, 607, 514, 515, 519, 633, 631, 489–493, 313/483–487, 475, 473, 56, 169.4, 623, 627–643, 567, 111–117, 25–27, 318.01–318.09; 439/615, 739; 445/24, 26, 29, 22; 315/63
See application file for complete search history.

(56) References Cited

U.S. PATENT DOCUMENTS 4,851,734 A * 7/1989 Hamai et al. ..... 313/485
(Continued)

FOREIGN PATENT DOCUMENTS

WO WO 03/107391 A1 12/2003

OTHER PUBLICATIONS

U.S. Appl. No. 12/596,069, filed Oct. 15, 2009, Auday, et al.

(Continued)

*Primary Examiner* — Nimeshkumar Patel
*Assistant Examiner* — Donald Raleigh
(74) *Attorney, Agent, or Firm* — Oblon, Spivak, McClelland, Maier & Neustadt, L.L.P.

(57) ABSTRACT

A flat discharge lamp transmitting radiation in ultraviolet or visible, including first and second flat, or substantially flat, glass elements substantially parallel to each other and defining an internal space filled with gas, the first and/or second glass element being made of a material that transmits the radiation; at least one first electrode and at least one second electrode, which may be at different potentials and may be supplied by an AC voltage, the first and second electrodes being associated with one or more main faces of the first glass element, the first and second electrodes being essentially elongate and substantially parallel to one another, and separated by at least one interelectrode space of given width substantially constant; and at least one third electrode which may be at a given potential associated with a main face of the second glass element and at least partly occupying, in projection, the interelectrode space.

32 Claims, 9 Drawing Sheets

U.S. PATENT DOCUMENTS

| | | | | |
|---|---|---|---|---|
| 6,252,352 | B1 * | 6/2001 | Vollkommer et al. | 313/574 |
| 6,878,154 | B2 * | 4/2005 | Griffith et al. | 607/94 |
| 2002/0030437 | A1 | 3/2002 | Shimizu et al. | |
| 2002/0154258 | A1 | 10/2002 | Fujishiro et al. | |
| 2005/0073258 | A1 | 4/2005 | Jang et al. | |
| 2005/0242739 | A1 * | 11/2005 | Kawashima | 315/63 |
| 2006/0076880 | A1 * | 4/2006 | Park et al. | 313/493 |

OTHER PUBLICATIONS

U.S. Appl. No. 12/596,305, filed Oct. 16, 2009, Joulaud, et al.

* cited by examiner

FLAT COPLANAR-DISCHARGE LAMP AND USES OF SAME

BACKGROUND OF THE INVENTION

I. Field of the Invention

The present invention relates to the field of flat lamps and in particular it relates to flat coplanar-discharge lamps and to the use of these lamps.

II. Description of Related Art

As is known, flat lamps, used for the manufacture of backlit liquid-crystal display (LCD) devices or as decorative or architectural luminaires, consist of two glass sheets kept apart by a short distance, generally less than a few millimeters, and hermetically sealed. The internal space contains a gas under reduced pressure, which emits ultraviolet (UV) radiation which excites a phosphor material emitting in the visible and covering the internal faces of the glass plates.

UV lamps are also formed by choosing a glass that transmits the UV radiation from the emitting gas or a phosphor material emitting in the UV.

In a conventional flat lamp structure, one of the glass sheets also has, on its internal face, electrodes mainly in the form of mutually parallel conducting bands. At a given instant, two adjacent electrodes constitute a cathode and an anode, between which what is called a coplanar discharge is produced, that is to say a discharge in a direction hugging the main surface of the supporting glass sheet.

To supply this coplanar discharge, a high-frequency voltage source is used that delivers a train of pulses with a short rise time, usually rectangular pulses.

It is also accepted that this coplanar discharge is homogeneous (i.e. filament-free) only with a duty cycle, (corresponding to the ratio of the conduction time to the period of the pulse train) that is very short, around 4%, which is technically complicated to achieve and consequently expensive.

To guarantee the homogeneity of the radiation from a conventional lamp, with a pulse train having a longer duty cycle, it will be necessary to combine an optical diffuser with the emitting surface. Here again, this complicates the production of the flat lamp. What is more, the thickness is increased, as is the weight. Furthermore, this solution cannot be easily transposed to UV lamps.

BRIEF SUMMARY OF THE INVENTION

The object of the invention is to provide a flat lamp with a homogeneous discharge. To broaden the range of flat lamps and to meet the industrial constraints, this lamp must also be simple to produce and to be supplied, and in particular to obviate the aforementioned constraints as regards the choice of supply signal in terms of rise time and/or duty cycle.

For this purpose, the invention proposes a flat discharge lamp transmitting radiation in the ultraviolet or the visible, comprising:

- first and second flat, or substantially flat, glass elements kept substantially parallel to each other and defining an internal space filled with gas, the first and/or second glass element being made of a material that transmits said radiation;
- at least one first electrode and at least one second electrode which may be at different potentials and may be supplied by an AC voltage, the first and second electrodes being associated with one or more main faces of the first glass element, the first and second electrodes being essentially elongate and substantially parallel to one another, and separated by at least one space, called the interelectrode space, of given width, called d1, which is substantially constant, the lamp further comprising at least one third electrode which may be at a given potential, associated with a main face of the second glass element and at least partly occupying, in projection, the interelectrode space.

The Applicant has discovered, surprisingly, that the third electrode or electrodes thus placed significantly reduce the problems of achieving discharge homogeneity.

In operation, the third electrode or electrodes may be supplied simply at ignition, preferably at least periodically or even more preferably permanently.

In particular, the discharge is homogeneous irrespective of the AC voltage chosen (sinusoidal or pulsed with a long or short duty cycle).

Preferably, all the electrodes are mainly in the form of bands.

Alternatively, the first and second electrodes may be of more complex, nonlinear, geometry, for example angled, V-shaped, zig-zagged or corrugated, while maintaining a substantially constant interelectrode space and width. In this alternative, the third electrode or electrodes preferably have the same structure (design) and remain available for at least partly filling one or more interelectrode spaces.

A great latitude is possible in respect of the electrode configurations:

- the first and second electrodes are not necessarily placed on the same face of the first glass element;
- the first and third electrodes may be substantially parallel or crossed;
- the first and third electrodes are preferably parallel to a longitudinal or lateral edge;
- the widths of the first and third electrodes may be different; and
- the projection of a third electrode may be centered between a first electrode and a second electrode, or else it may be offset.

For example, the third electrodes are parallel to the first electrodes and at least one third electrode faces an interelectrode space.

The third electrodes may also be perpendicular to a first electrode, and portions of third electrodes then face the same interelectrode space. The distance between two adjacent third electrodes may be equal to or different from the width d1 of the interelectrode space.

The lamp may be large, for example with an area of at least 1 $m^2$.

In one lamp configuration with only one face transmitting the radiation, for example the first glass element, the other glass element, the second in this example, may be of any type, possibly opaque, for example it may be a glass-ceramic, or even a non-glass dielectric. The partially translucent character may serve to position the lamp and/or to display or verify the operation of the lamp.

Preferably, the possibly overall transmission factor of the lamp according to the invention about the peak of said radiation is equal to 50% or higher, more preferably equal to 70% or higher, and even 80% or higher.

In a first embodiment of the invention, said potential is a DC potential. This potential V may be less than 1000V, especially between 300 and 500V or even less than 100V. Simple grounding is recommended, guaranteeing electrical safety.

Preferably, in this first embodiment, the projection of the third electrode(s) may occupy at least 50%, preferably at least 80% and even more preferably 100% of the interelectrode space.

The more the projection of the third electrode or electrodes fills the space, the better the homogeneity.

Alternatively, the third electrode may substantially cover the entire said main face.

In one advantageous embodiment, the first, second and third electrodes principally form mutually parallel bands the first and second electrodes having a substantially identical width, called I1, the third electrode or electrodes having a width called I2.

In this latter embodiment, the following configurations are preferred:

- the widths I1 and I2 are substantially identical and equal to the width d1;
- since the widths I1 and I2 are substantially identical, the ratio of I1 to d1 is greater than 1, for example I1 is equal to kd1 where k is an integer greater than 1; and
- the third electrodes having a width called I2 and being separated by at least one other space of substantially constant width called d3, the sum I1+d1 being substantially equal to the sum I2+d3, I1 being greater than 1 and d1 being less than d3, for example I1 is equal to k'I2 where k' is an integer greater than 1 and d3 may be equal to or greater than I2.

The third electrode or electrodes may also have one or more of the following additional functions, namely of:

- reflecting in the visible or in the UV;
- providing a solar-control or low-emissivity function;
- or else, for radiation in the visible, forming an electrode of an optoelectronic element associated with the flat lamp (an electrochromic or switchable mirror element, especially in multilayer systems), for example to vary the color, the transparency or the light transmission or reflection properties, by therefore choosing the appropriate potential, for example one of around a few volts or around 10 volts.

In a second embodiment of the invention, the lamp comprises at least one fourth electrode associated with a main face of the second glass element, which is essentially elongate and substantially parallel to the third electrode or electrodes and the third and fourth electrodes may be at different potentials and may be supplied by an AC voltage.

In this way, a second coplanar discharge is formed, thereby furthermore very appreciably improving the luminance and/or the luminous efficiency.

The fourth electrode or electrodes may be placed facing a first or a second electrode, or they may be placed, by projection, between a first electrode and a second electrode and one edge of the first glass element.

More generally a fourth electrode may also contribute to improving the homogeneity of the discharge, by at least partly occupying an interelectrode space. For example, the width d1 is appreciably greater than that between the third and fourth electrodes placed facing this space.

Also advantageously, a projection of a third and/or a fourth electrode at least partly occupies an interelectrode space.

The projection of the third and/or fourth electrodes may occupy at least 50%, preferably at least 80% and even more preferably 100% of the associated interelectrode space.

The increase in optical performance is optimal in the case of 100%. The luminous efficiency may reach at least 30 lm/W or even 40 lm/W. The luminance may reach at least 1500 $Cd/m^2$ or even 2500 $Cd/m^2$.

For simplicity of production, the first, second, third and fourth electrodes principally form mutually parallel bands, the first and second electrodes have a substantially identical width called I1 and the third and fourth electrodes have a substantially identical width called I2 and are separated by an interelectrode space of width called d2.

Preferably, the sum I1+d1 is equal to the sum of I2+d2 in order to better fill all the interelectrode spaces, with no offset.

In a first configuration, the width I1 and I2 are substantially identical and equal to the widths d1 and d2.

In a second configuration, the widths I1 and I2 are substantially identical, the widths d1 and d2 are substantially identical, and the ratio of I1 to d1 is greater than 1, preferably equal to or greater than 5, or even more preferably equal to or greater than 10. For example, I1 is equal to kd1 where k is an integer greater than 1.

In a third configuration, the sum I1+d1 is substantially equal to the sum I2+d2, I1 is greater than I2, and d1 is less than d2, it being possible for d2 to be equal to or greater than I2.

Of course, the choice of the widths I1, I2, d1 and d2 may also apply to the exemplary embodiment comprising third electrodes at a DC potential, identifying d2 as the space between two adjacent third electrodes.

The width d1 of the first and second electrodes may be greater than 0.5 cm, preferably equal to or greater than 1 cm and even more preferably equal to or greater than 4 cm, in order to allow the lamp be lit with a relatively low voltage and to spread the plasma so as to increase the luminance.

The flat lamp according to the invention may advantageously be used as a luminaire capable of simultaneously illuminating via its two main faces, and in particular as an illuminating window when its structure includes no opaque or reflecting layer capable of limiting the light transmission on the one hand, or of the lamp on the other. However, for esthetic reasons, it is possible to preclude the illumination through one face or part of one face of the lamp, for example in order to contribute to the production of the desired feature. Likewise, the lamp itself may be provided with such a screen, or else this screen may be associated with it when mounting the final luminaire.

Also preferably, the lamp transmits said radiation via the first and second glass elements.

The emission may be chosen to be identical or differentiated, for example two levels of illumination, by varying the thicknesses of the phosphors, by choosing electrode materials of different transparency, or else by choosing different opaque electrode sizes.

Moreover, the electrodes may be placed in the internal space so as to reduce the dielectric thickness and therefore to increase the amplitude of the AC voltage.

In one advantageous embodiment, the first and second electrodes and/or the third electrode or electrodes are placed outside the internal space.

In this configuration, the glass element associated with the electrodes acts as capacitive protection for the electrodes against ion bombardment, and consequently forms a dielectric of constant thickness and excellent uniformity, guaranteeing uniformity of the radiation emitted by the lamp.

This structure, when the electrodes are placed outside the enclosure under a reduced pressure of plasma gas, allows the manufacturing cost of the lamp to be reduced. The manufacture of the lamp is also simplified, manufacturing errors being eliminated. In addition, the connection to the electrical supply is simple, the electrical connectors not having to pass through the hermetically sealed enclosure containing the gas.

In this latter embodiment, the electrodes outside the internal space may be covered or incorporated at least partly into a dielectric element, for example a flat element, chosen from the first or second glass element, or another glass element, and/or at least one plastic, and possibly a glass or plastic element associated with a gas layer.

A vast range of dielectrics and geometries may be chosen. This dielectric element may form part of an insulating, vacuum or argon-filled, glazing unit, or a glazing unit with a single air cavity. A simple varnish of sufficient thickness may also be used.

The dielectric element serves as mechanical or chemical protection and/or forms a lamination interlayer and/or provides satisfactory electrical isolation should it be required, for example if this space bearing the electrodes is easily accessible.

Thus, the first electrodes (or the third electrode or electrodes) may be associated with the first (or the second) glass element in various ways. They may be incorporated into this element, they may be directly deposited on an external face, or they may be deposited on a dielectric carrier element, joined to the first (or to the second) glass element in such a way that the electrodes are pressed against its external face.

The electrodes may also be sandwiched between a first dielectric and a second dielectric, by simply being inserted during manufacture, or by being combined with one of the two dielectrics, the assembly being joined to the first (or second) glass element.

In a first example, the first dielectric is a lamination interlayer and the second dielectric is a back glass plate or a rigid plastic, preferably transparent.

In a second example, the electrodes are on a preferably thin dielectric between two lamination interlayers, the dielectric being for example a plastic film or a thin glass sheet.

As a variant, the electrodes may be placed between said first (or second) glass element and the first dielectric, which is for example a lamination interlayer.

These first and second elements may therefore be formed in various combinations, by combining for example a glass or plastic element (whether rigid, monolithic or laminated), and/or plastics or other resins capable of being assembled by adhesive bonding with glass products.

Suitable plastics are, for example:

- polyurethane (PU) used soft, a thermoplastic with no plasticizers, such as an ethylene/vinyl acetate copolymer (EVA), or polyvinyl butyral (PVB), these plastics serving as adhesive lamination interlayer film, for example with a thickness of between 0.2 mm and 1.1 mm, especially between 0.3 and 0.7 mm, these plastics optionally incorporating the electrodes in their thickness or carrying the electrodes;
- rigid polyurethane (PU), a polycarbonate, or an acrylate such as polymethylmethacrylate (PMMA), these plastics being used especially as rigid plastic, and optionally bearing electrodes.

It is also possible to use PE, PEN or PVC, or polyethyleneterephthalate (PET), the latter possibly bearing electrodes, and possibly being thin, especially between 10 and 100 μm in thickness. Where appropriate, measures are taken to ensure, of course, compatibility between the various plastics used, especially their good adhesion.

It is possible to use a sheet carrying electrodes on the opposite side from the assembly face and, as an option, a sheet of the same nature in order to protect the electrodes.

Of course, any aforementioned dielectric element is chosen to be substantially transparent to said radiation (visible or UV) if it is placed on the emission side of the lamp.

In a preferred embodiment, for simplicity of design and lower production costs, the AC voltage is in the form of pulses with a duty cycle of preferably at least 5%, preferably at least 10%, or is sinusoidal or sinusoidally arched.

To give an illustration, let Va and Vb be the amplitudes of the AC voltages of the first and second electrodes respectively. The signal Va(t) is between −Va and +Va, and the signal Vb(t) is between −Vb and +Vb.

For example, Va is chosen to be between 500 and 1000V, depending on the chosen pressure, and Vb between 0 and 200V. More precisely, either Vb is ground or the signal Vb(t) is in phase opposition with the signal Va(t).

In one embodiment with a double discharge, let the Vc and Vd be the amplitudes of the AC voltages of the third and fourth electrodes respectively.

For the sake of simplification, it is preferred to choose Vc to be equal to Va (or Vb respectively) and for Vd to be equal to Vb (or Va respectively).

The pulses may be of any waveform, whether positive and/or negative, and with a nonzero reference level.

As regards the frequency, this may be chosen between 10 kHz and 100 kHz.

Moreover, the first and second electrodes and/or the third and fourth electrodes may be chosen to be transparent or translucent, in particular for applications in the illumination field, for example made of a conducting metal oxide, or having electron vacancies, especially made of fluorine-doped tin oxide ($SnO_2$:F) or a mixed indium tin oxide (ITO).

The electrodes are for example solid electrodes. They may especially be formed from contiguous conducting wires (parallel wires, braided wires, etc.) or from a ribbon (made of copper, etc.) to be adhesively bonded, or from a coating deposited by any means known to those skilled in that art, such as liquid deposition, vacuum deposition (magnetron sputtering, evaporation), by pyrolysis (powder or gas) or by screen printing. To form bands, it is possible in particular to employ masking systems, in order to obtain the desired distribution directly, or else to etch a uniform coating by laser ablation or by chemical or mechanical etching.

The electrodes may also each be in the form of an array of essentially elongate conducting features, such as conducting lines (likened to very narrow bands) or actual conducting wires. The features may be substantially straight or corrugated, or in a zig-zag configuration, etc.

This array may be defined by a given pitch p1 between features (minimum pitch in the case of a plurality of pitches) and width I4 of features (maximum width in the case of a plurality of widths). Two series of features may cross. This array may in particular be organized like a grid, a fabric or a cloth. These features are made of metal, for example tungsten, copper or nickel.

Thus, it is possible to obtain overall transparency (in UV or the visible):

- using, for example, an opaque electrode material, especially as a thin film, and limiting the width of the electrodes I1 (or I2) and/or
- using an array of conducting features and by adapting, according to the desired transparency, the width I4 and/or the pitch p1 and, optionally, the width I1 (or I2) and/or d1.

Thus, the ratio of the width I4 to the pitch p1 may be equal to 50% or less, preferably 10% or less and even more preferably 1% or less.

For example, the pitch p1 may be between 5 μm and 2 cm, preferably between 50 μm and 1.5 cm and even more preferably between 100 μm and 1 cm, and the width I4 may be between 1 μm and 1 mm and preferably between 10 and 50 μm.

To give an example, it is possible to use a conducting array on a plastic sheet, for example of the PET type, with a pitch p1 of 100 μm and width I4 of 10 μm, or else to incorporate, at least partly, into a lamination interlayer, especially made of PVB or PU, with an array of conducting wires with a pitch p1 between 1 and 10 mm, especially 3 mm, and a width I4 between 10 and 50 μm, especially between 20 and 30 μm.

The ratio of d1 to I1 (or d2 to I2, or d3 to I2) is adjusted according to the desired (UV or visible) transparency, it being possible for this ratio to be preferably equal to 50% or less, preferably 20% or less.

Moreover, the lamps according to the invention may have no phosphors.

As gas emitting in the visible, for example for screened light, mention may be made of the rare gases (helium, neon, argon, krypton, xenon), or other gases (air, oxygen, nitrogen, hydrogen, chlorine, methane, ethylene, ammonia etc.) and mixtures thereof.

The gas or gases are chosen according to the color, for example neon in the gas of orange, xenon in the case of blue, helium in the case of pink, xenon and diatomic oxygen in the case of green, and argon in the case of violet.

Thus, it is possible to produce a wall that is transparent in "off" state (using transparent electrodes and transparent glass elements) and is luminous, for a privacy effect in the "on" state.

The lamps according to the invention may contain at least one phosphor, partly or completely covering one face, for example the internal face of the first and/or of the second glass element.

The phosphor may emit radiation in the visible or in the UV, and may itself be transparent.

For example, all or part of the internal faces of at least one of the two glass elements may be coated with a phosphor material emitting radiation in the visible. Thus, even if the electrodes cause discharges throughout the volume of the lamp, a differentiated distribution of the phosphor in certain regions makes it possible to convert the energy from the plasma into visible radiation only in the regions in question, so as to constitute illuminating regions and juxtaposed transparent regions. These regions may also possibly form decorative features or form a display, such as a logo or a trademark.

The phosphor material may advantageously be selected or adapted so as to determine the color of the illumination over a wide pallet of colors.

The lamp according to the invention with radiation in the visible may be used for decorative, architectural, domestic or industrial lighting, especially to form a flat luminaire, such as an illuminating wall, especially one that is suspended, or an illuminating tile. It may also have a display or indicating function, for example forming a panel of the teaching type, etc.

The lamp may also be an illuminating window, a showcase, a rack element, a refrigerator shelf or it may be a device for backlighting a liquid-crystal display screen.

The gas is chosen for example from xenon Xe or an A/Xe mixture, where A=Ne, He, Ar, the percentage of A varying between 0 and 90%. The pressure may take any value between 10 and 1000 mbar, preferably from 100 to 200 mbar.

The lamp according to the invention with UV radiation may be used in the following fields: esthetics; electronics; for food; as a tanning lamp; for disinfecting or sterilizing surfaces, air or water, whether tap water, drinking water or swimming pool water; for the treatment of surfaces in particular before deposition of active films; for activating a photochemical process of the polymerization or crosslinking type; for drying paper; for analyses based on fluorescent materials; for activating a photocatalytic material.

The material of the glass element or elements transmitting UV radiation may be preferably chosen from quartz, silica, magnesium fluoride ($MgF_2$) or calcium fluoride ($CaF_2$), a borosilicate glass, or a glass with less than 0.05% $Fe_2O_3$.

To give examples, for thicknesses of 3 mm:

- magnesium or calcium fluorides transmit more than 80%, or even 90%, over the range of UV bands, that is to say UVA (between 315 and 380 nm), UVB (between 280 and 315 nm), UVC (between 200 and 280 nm) and VUV (between 10 and 200 nm);
- quartz and certain high-purity silicas transmit more than 80%, or even 90%, over the range of UVA, UVB & UVC bands;
- borosilicate glass, such as Borofloat® from Schott, transmits more than 70% over the entire UVA band; and
- soda-lime-silica glass with less than 0.05% $Fe_2O_3$, especially the glass Diamant® from Saint-Gobain, the glass Optiwhite® from Pilkington, and the glass B270 from Schott, transmits more than 70% or even 80% over the entire UVA band.

However, a soda-lime-silica glass, such as the glass Planilux® sold by Saint-Gobain, has a transmission of more than 80% above 360 nm, which may be sufficient for certain constructions and certain applications.

By choosing radiation in the UVA or even in the UVB, the UV lamp as described above may be used,

- as a tanning lamp (99.3% in the UVA and 0.7% in the UVB according to the standards in force);
- for photochemical activation processes, for example for polymerization, especially of adhesives, or crosslinking or for drying paper;
- for the activation of fluorescent material, such as ethidium bromide used in gel form, for analyzing nucleic acids or proteins; and
- for activating a photocatalytic material, for example for reducing odors in a refrigerator or dirt.

By choosing radiation in the UVB, the lamp promotes the formation of vitamin D in the skin.

By choosing radiation in the UVC, the UV lamp as described above may be used for disinfecting/sterilizing air, water or surfaces, by a germicide effect, especially between 250 nm and 260 nm.

By choosing radiation in the far UVC or preferably in the VUV for ozone production, the UV lamp as described above is used especially for the treatment of surfaces, in particular before the deposition or active films for electronics, semiconductors, etc.

The electrodes may be based on the material that transmits said UV radiation or they may be arranged so as to allow overall transmission of said UV radiation (if the material is absorbent to or reflective of UV radiation).

The electrode material transmitting said UV radiation may be a very thin film of gold, for example around 10 nm in thickness, or of alkali metals, such as potassium, rubidium, cesium, lithium or potassium, for example with a thickness of 0.1 to 1 μm, or else an alloy, for example a 25% sodium/75% potassium alloy.

An electrode material relatively opaque to said UV radiation is for example silver, copper or aluminum, or else fluoride-doped tin oxide ($SnO_2$:F) or mixed indium tin oxide (ITO), at the very least below 360 nm. This is because between 360 and 380 nm, a soda-lime-silica glass, for example 4 mm in thickness, covered with $SnO_2$:F transmits about 60% of this UVA.

In the structure of the flat UV lamp according to the invention, the gas pressure in the internal space may be around 0.05 to 1 bar. A gas or a gas mixture is used, for example a gas that efficiently emits said UV radiation, especially xenon, or mercury or halides, and an easily ionizable gas capable of forming a plasma (plasma gas), such as a rare gas like neon or helium, xenon or argon, or a halogen, or even air or nitrogen.

The halogen content (when the halogen is mixed with one or more rare gases) is chosen to be less than 10%, for example 4%. It is also possible to use halogenated compounds.

The rare gases and the halogens have the advantage of being insensitive to the environmental conditions.

Table 1 below indicates the radiation peaks of the particularly effective UV-emitting gases.

TABLE 1

| UV-emitting gas | Peak(s) (in nm) |
|---|---|
| Xe | 172 |
| $F_2$ | 158 |
| $Br_2$ | 269 |
| $Cl_2$ | 259 |
| $I_2$ | 342 |
| XeI/KrI | 253 |
| ArBr/KrBr/XeBr | 308/207/283 |
| ArF/KrF/XeF | 351/249/351 |
| ArCl/KrCl/XeCl | 351/222/308 |
| Hg | 185, 254, 310, 366 |

There are in particular phosphors that emit in the UVC from exposure to VUV radiation. For example, UV radiation at 250 nm is emitted by phosphors after being excited by VUV radiation shorter than 200 nm, such as from mercury or a rare gas.

There are also phosphors that emit in the UVA or near UVB when exposed to VUV radiation. Mention may be made of gadolinium-doped materials such as: $YBO_3$:Gd; $YB_2O_5$:Gd; $LaP_3O_9$:Gd; $NaGdSiO_4$; $YAl_3(BO_3)_4$:Gd; $YPO_4$:Gd; $YAlO_3$:Gd; $SrB_4O_7$:Gd; $LaPO_4$:Gd; $LaMgB_5O_{10}$:Gd,Pr; $LaB_3O_8$:Gd,Pr; and $(CaZn)_3(PO_4)_2$:Tl.

There also phosphors that emit in the UVA when exposed to UVC radiation. Mention may for example be made of $LaPO_4$:Ce; $(Mg,Ba)Al_{11}O_{19}$:Ce; $BaSi_2O_5$:Pb; $YPO_4$:Ce, $(Ba,Sr,Mg)_3Si_2O_7$:Pb and $SrB_4O_7$:Eu.

For example, UV radiation above 300 nm, especially between 318 nm and 380 nm, is emitted by phosphors after being excited by UVC radiation of around 250 nm.

Furthermore, it may be advantageous to incorporate a coating having a given functionality into the UV lamp according to the invention. This may be an anti-soiling or self-cleaning coating, especially a $TiO_2$ photocatalytic coating deposited on the glass element opposite the emitting face, this coating possibly being activated by UV radiation.

The lamp according to the invention may for example be incorporated into household electrical equipment, such as a refrigerator, kitchen shelf, etc.

For all lamps according to the invention, the glass elements may be slightly curved, with the same radius of curvature, and are preferably kept a constant distance apart, for example by spacers, such as glass beads. These spacers, which may be termed discrete spacers when their dimensions are considerably smaller than the dimensions of the glass elements, may take various forms, especially in the form of spheres, parallel-faced bitruncated spheres, cylinders, but also parallelepipeds of polygonal cross section, especially cruciform cross section, as described in document WO 99/56302.

The gap between the two glass elements may be fixed by the spacers so as to have a value of around 0.3 to 5 mm. A technique for depositing the spacers in vacuum insulating glazing units is known from FR-A-2 787 133. According to this process, spots of adhesive are deposited on a glass plate, especially spots of enamel deposited by screen printing, with a diameter equal to or less than the diameter of the spacers, and then the spacers are rolled over the glass plate, which is preferably inclined, so that a single spacer adheres to each spot of adhesive. The second glass plate is then placed on the spacers and the peripheral seal deposited.

These spacers are made of a nonconducting material in order not to participate in the discharges or to cause a short circuit. Preferably, they are made of glass, especially of the soda-lime type.

To prevent light loss by absorption in the material of the spacers, it is possible to coat the surface of them with a material that is transparent or reflective in the visible or UV, or with a phosphor material identical to or different from that used for the glass element(s).

According to one embodiment, the lamp may be produced by manufacturing firstly a sealed enclosure in which the intermediate air cavity is at atmospheric pressure, then a vacuum is created and the plasma gas introduced at the desired pressure. According to this embodiment, one of the glass elements includes at least one hole drilled through its thickness and obstructed by a sealing means.

BRIEF DESCRIPTION OF THE DRAWINGS

Further details and advantageous features of the invention will become apparent on reading the examples of flat lamps illustrated by the following figures.

DETAILED DESCRIPTION OF THE INVENTION

It should be pointed out that, for the sake of clarity, the various elements of the objects shown are not necessarily drawn to scale.

Figure 1:
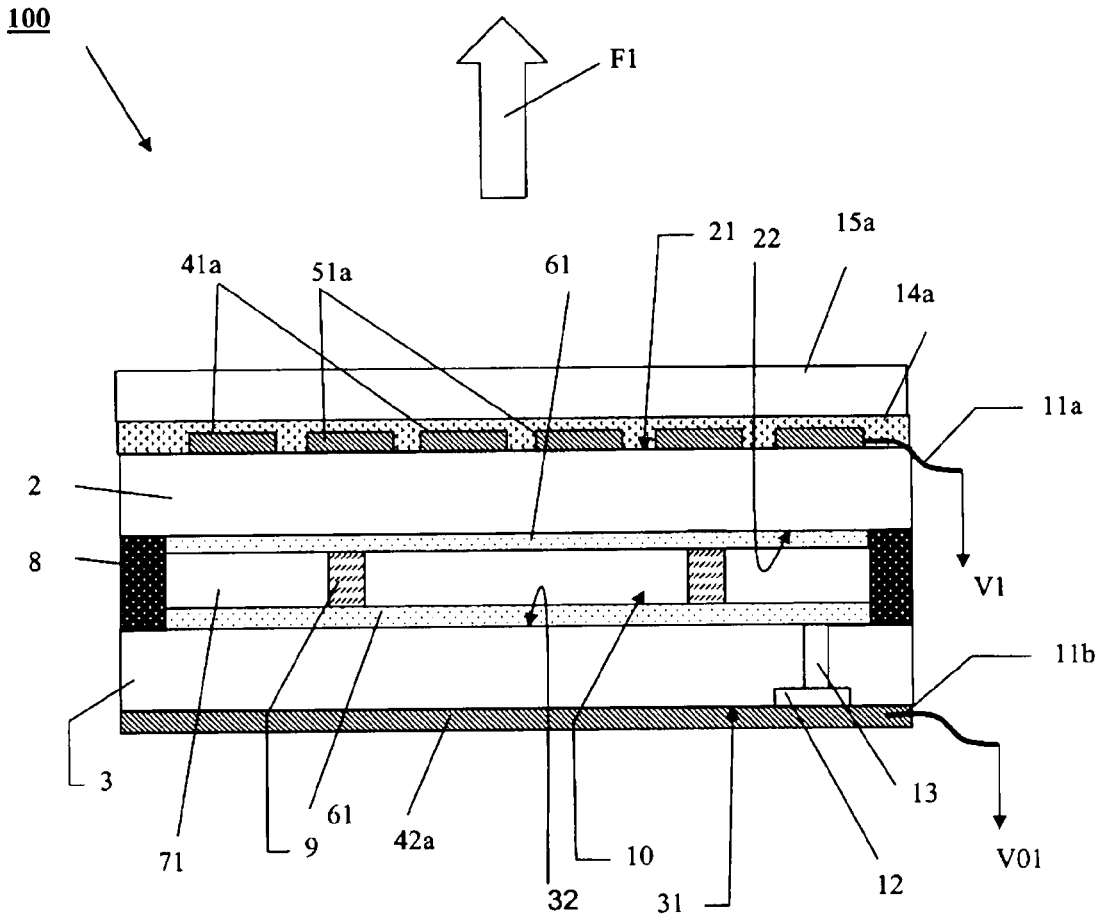
FIG. 1 shows schematically a sectional view of a flat coplanar-discharge lamp according to a first embodiment of the invention.

FIG. 1 shows a flat discharge lamp 100 comprising first and second glass plates 2, 3, each having an external face 21, 31 and an internal face 22, 32.

The lamp 100 emits radiation in the visible only via its face 21 (the radiation being indicated symbolically by the arrow F1), for example for use as an illuminating tile, ceiling or wall lighting, or as backlighting for a liquid-crystal matrix, or else to be incorporated into a household electrical appliance.

The plates 2, 3 slot together so that their internal faces 22, 32 face each other and are joined together by means of a sealing frit 8, for example a glass frit having a thermal expansion coefficient close to that of the glass plates 2, 3, such as a lead frit.

As a variant, the plates are joined together by an adhesive, for example a silicone adhesive, or else by a heat-sealed glass frame. These sealing methods are preferable if plates 2, 3 having different expansion coefficients are chosen. This is because the plate 3 may be made of a glass material or more generally a dielectric material suitable for this type of lamp, whether translucent or opaque.

The area of each glass plate 2, 3 is for example about 1 $m^2$, or even more, and the thickness of each plate is 3 mm. A soda-lime-silica glass is chosen. The plates are for example square.

The gap between the glass plates is set (generally to a value of less than 5 mm) by glass spacers 9 placed between the plates. Here, the gap is for example between 1 and 2 mm. The spacers 9 may have a spherical, cylindrical or cubic shape, or they may have another polygonal, for example cruciform, cross section. The spacers may be coated, at least on their lateral surface exposed to the plasma gas atmosphere, with a material that reflects visible light.

The second glass plate 3 has, near the periphery, a hole 13 drilled through its thickness, a few millimeters in diameter, the external orifice of which is obstructed by a sealing pad 12, especially made of copper, welded to the external face 31.

In the space 10 between the glass plates 2, 3 there is a reduced pressure of 250 mbar of a 50% neon/50% xenon mixture 71 in order to emit exciting radiation in the VUV. The height of gas may be between 0.5 mm and a few mm in height, for example 2 mm.

The internal faces 22, 32 are coated with a phosphor coating 61 that emits in the visible, for example a single color, or a mixture of colors. The phosphor may be thicker on the face 32 in order to increase the illumination.

Placed on the external face 21 are a plurality of first and second electrodes 41*a*, 51*a* coupled pairwise, giving an alternation of first and second electrodes. They may be in the form of mutually parallel solid bands parallel to the edge of the plates 2, 3 and with a conducting, preferably transparent, coating, for example made of fluorine-doped tin oxide.

As a variant, opaque bands are chosen, especially screen-printed silver bands, or adhesively bonded copper bands, these bands preferably being thinner or apertured for satisfactory overall transmission.

First and second electrodes are deposited directly on the face 21 and are covered, in this order, by a lamination interlayer 14*a*, thus forming a first transparent electrical insulator, for example PVB, EVA or PU and a back glass plate 15*a* or any other second transparent electrical insulator, and especially polycarbonate or PMMA. In particular, a diffusing back glass plate may be chosen, or one with which a diffuser may be associated.

Furthermore, the first and second electrodes 41*a*, 51*a*, could also be sandwiched between the lamination interlayer 14*a* and the back glass plate 15*a*, the combination being joined to the glass sheet 2.

Thus, these first and second electrical insulators 14*a*, 15*a* may be formed in various combinations, for example combining a glass sheet and/or plastics or other resins that are capable of being joined by adhesive bonding to glass products.

Thus, it is possible to add a PET carrying electrodes, for example those deposited by magnetron sputtering, and another lamination interlayer between the insert 14*a* and the back glass plate 15*a*.

The first and second electrodes 41*a*, 51*a* may be combined with the glass plate 2 in other ways, without a back glass plate. They may be deposited on a carrier element which is a transparent electrical insulator, for example a plastic, this carrier element being joined to the glass plate in such a way that the coating is pressed against its face 21. This electrical insulator may for example be a PET plastic film bonded to the external frame 21 with adhesive.

According to other variants, the first and second electrodes 41*a*, 51*a* could also be incorporated into the glass plate 2, for example in the form of bands consisting of a conducting array, it then being possible for the first and second electrical insulators to be omitted.

They may also be in the lamination interlayer 14*a* in the form of bands consisting of an array of wires with a pitch p1 of 3 mm and a weight l4 of about 20 μm.

In a final variant, the first and second electrodes 41*a*, 51*a* are deposited on the internal face 32, beneath the phosphor layer 61 and an intermediate layer made of an opaque or transparent dielectric, of the glass frit or bismuth type.

The first and the second electrodes 41*a*, 51*a* are supplied with voltage via a flexible shim 11*a* or, as a variant, via a welded wire. More precisely, each first electrode (or second electrode respectively) is connected to one and the same busbar (not shown for the sake of clarity) that is deposited on the periphery of the glass sheet 2 and connected to said shim.

The high-frequency voltage signal is for example a sinusoidal signal with an amplitude V1 of about 1500V and a frequency between 10 and 100 kHz, for example 40 kHz. A coplanar discharge is produced between each pair of electrodes 41*a*, 51*a*.

Only the first electrodes 41*a* are supplied by the sinusoidal signal, the second electrodes 51*a* then being grounded. Alternatively, the first and second electrodes 41*a*, 51*a* are supplied by sinusoidal signals in phase opposition, for example at 750V.

Of course, a control system may be provided for varying the amplitude, and therefore, the illumination.

To obtain a sufficiently homogeneous discharge, even with this sinusoidal supply signal, the glass plate 3 is provided with a conductive coating, covering substantially its entire external face 21 and forming a third electrode 42*a*. This coating is opaque, for example made of silver deposited by screen printing.

As in the case of the first and second electrodes, this third electrode may be covered with one or more dielectrics and/or incorporated into a dielectric, for example incorporated into a lamination, and also it may be in the form of a conducting array. It is then unnecessary for the first and second dielectrics used to be transparent.

This third electrode 42*a* could also be incorporated into the glass plate 2, for example in the form of a mesh of conducting wires.

This third electrode may also be deposited on the internal face 32, beneath the phosphor layer 61 and an intermediate layer made of an opaque or transparent dielectric, of the glass frit or bismuth type.

This third electrode 42*a* is grounded at ignition.

This third electrode 42*a* may reflect the visible radiation onto the face 22, preferably choosing aluminum for this.

This third electrode may also serve as electrode for an optoelectronic element (not shown) associated with the flat lamp, for example a switchable mirror.

Denoting the width of the first and second electrodes 41*a*, 51*a* by I1 and the width of the interelectrode space, that is to say the space between first and second adjacent electrodes 41*a*, 51*a*, by d1, then I1 is chosen to be equal to or greater than d1, for example I1 is equal to a few centimeters, especially 5 cm, and d1 is equal to about 0.5 cm.

As a variant, this lamp 100 has two emitting faces, and serves as a lamp for decorative or architectural illumination, etc. A transparent material is then chosen for electrodes 42*a* or electrodes 41*a*, 51*a*, 42*a* consisting of a conducting array with a ratio of width to pitch of preferably less than 50%, for satisfactory overall transparency.

This lamp 100 may also be an illuminating (and overall transparent) window or it may be associated with a building window (transom, etc) or a vehicle window (sunroof, side windows, etc.). A transparent phosphor 61 and a transparent material for the electrodes 41*a*, 51*a*, 42*a* or the electrode 41*a*, 51*a*, 42*a* consisting of a conducting array will then be chosen, with a width-to-pitch ratio of preferably 10% or less, or even 1% or less, for optimum overall transparency. This third electrode 42*a* may furthermore fulfill a solar-control or low-emissivity function.

Figure 2:
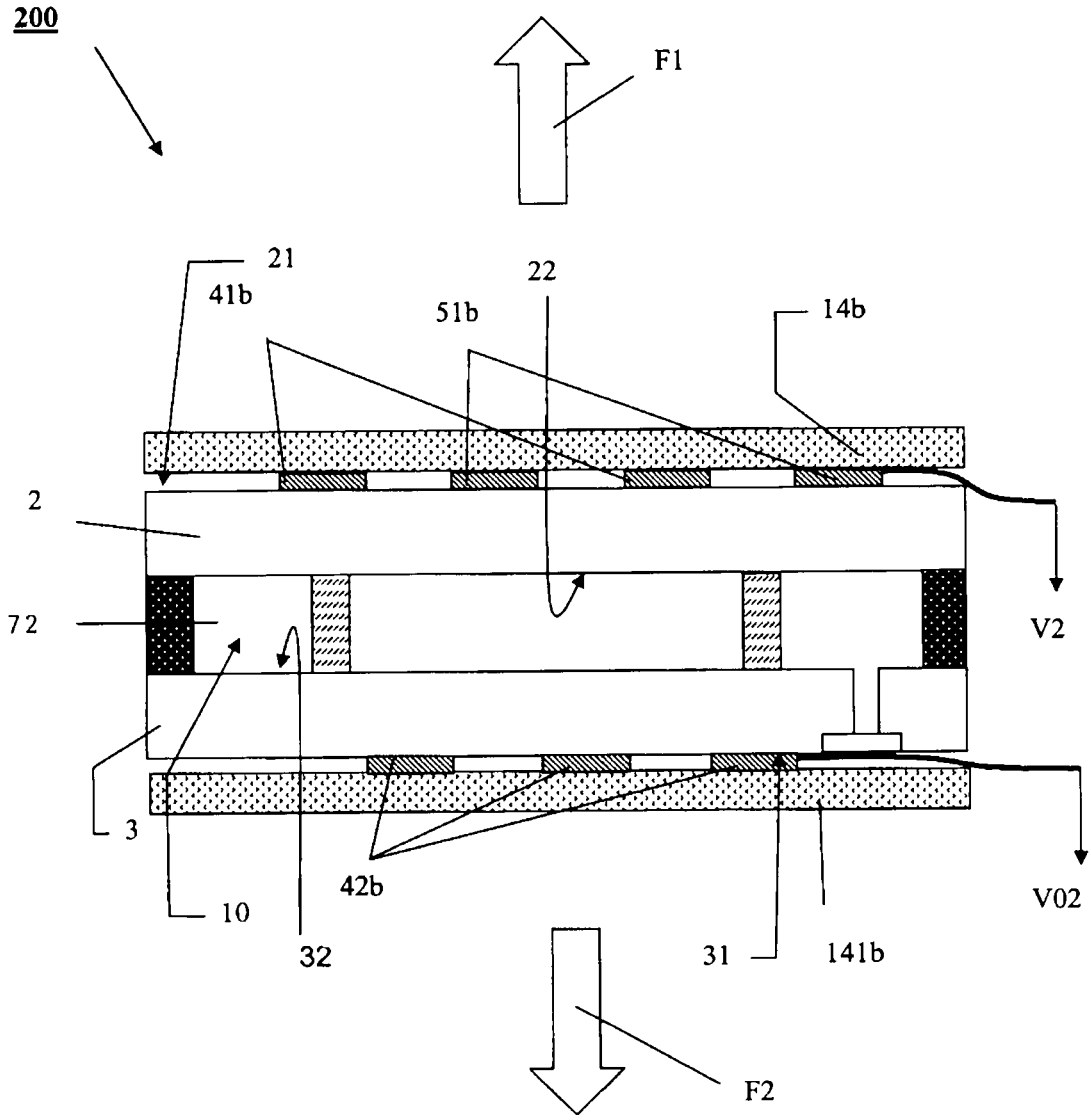
FIG. 2 shows schematically a sectional view of a flat coplanar-discharge UV lamp in a second embodiment of the invention.

In the embodiment shown in FIG. 2, the structure 200 of the flat coplanar-discharge lamp adopts the same structure as in FIG. 1 except for the elements detailed below.

The radiation is emitted directly by a gas 72, in order for example to obtain colored homogeneous screened light, the phosphors being omitted. As gas 72, argon may for example be chosen, giving a violet light.

This lamp emits via the two faces 21, 31 (the radiation being shown symbolically by the arrows F1, F2) and may for example serve as a luminous wall or partition.

The lamp 200 comprises a plurality of third electrodes 42*b*, each being a band centered with respect to an interelectrode space and occupying, in projection, this entire space.

All the electrodes are mutually parallel and parallel to the edges of the plates 2, 3. They have the same width I1 or I2, typically 4 cm, and this width is equal to the width d1 and to the width d3 between third electrodes 42*b*.

Moreover, the first and second electrodes 41*b*, 51*b* on the one hand and third electrodes 42*b* on the other hand are transparent conducting layers deposited on electrically insulating carrier elements 14*b*, 141*b* respectively, this carrier element being joined to the respective glass plate 2, 3 in such a way that the electrodes are pressed against its respective face 21, 31, for example by adhesive bonding. The electrical insulator 14*b*, 141*b* may for example be PET or else a polycarbonate.

In a variant, the electrodes are conducting arrays, for example made of copper, with a width I4 to pitch p1 ratio of preferably 10% or less, or even 1% or less, for very satisfactory overall transparency.

The positions of the electrodes 41*b*, 51*b*, 42*b* relative to the associated glass plates 2, 3, and their nature, may vary as described in the case of the electrodes 41*a*, 51*a* of the first embodiment.

The positions of the electrodes 41*b*, 51*b* and of the third electrode 42*b* relative to the associated glass plates 2, 3 may be different, for example with a single lamination associated with one of the glass plates, as described in the case of the electrodes 41*a*, 51*a* of the first embodiment.

Furthermore, the first and second electrodes 41*b*, 51*b* are supplied by an AC signal in the form of a train of pulses, for example positive rectangular pulses with a duty cycle of about 15% and an amplitude V2 of 800V.

The first electrodes 41*b* may also be supplied with voltage and the second electrodes 51*b* may be grounded.

Finally, the third electrode 42*b* is supplied with a DC voltage, V02 chosen to be 100V or 0V.

Figure 3:
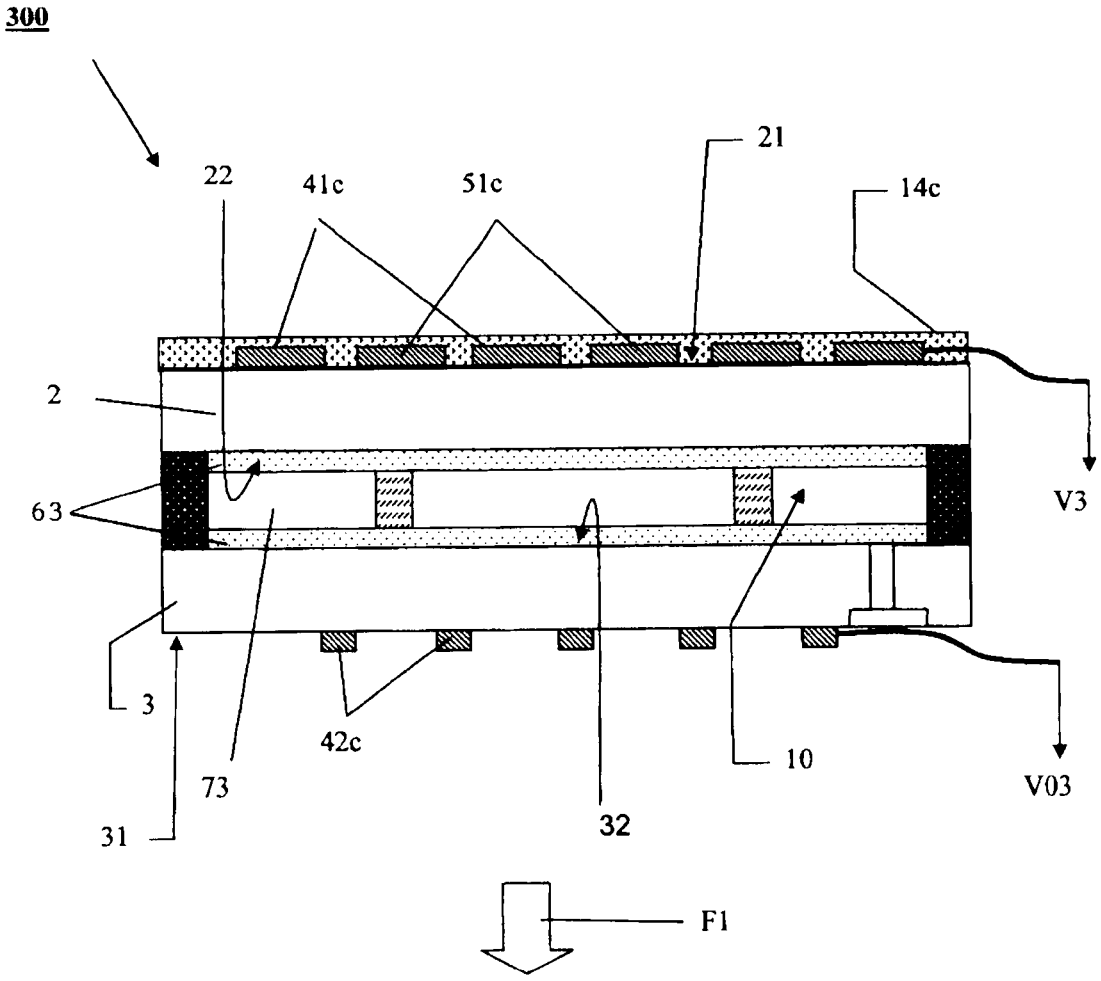
FIG. 3 shows schematically a sectional view of a flat coplanar-discharge lamp according to a third embodiment of the invention.

In the embodiment shown in FIG. 3, the structure 300 of the flat coplanar-discharge lamp is the same as the structure shown in FIG. 1, except for the elements detailed below.

The lamp 300 emits UVA radiation only via its face 31 (the radiation being shown symbolically by the arrow F1), for example for use in a tanning lamp.

In the space 10 between the plates 2, 3 there is a reduced pressure of 200 mbar of a xenon/indium mixture 73 in order to emit exciting radiation in the UVC.

The internal faces 22, 32 (or, in a variant, the internal face 22 alone, or even with the external face in a suitable glass) bear a coating 63 of a phosphor material emitting radiation in the UVA, preferably beyond 350 nm, such as $YPO_4$:Ce (peak at 357 nm) or $(Ba,Sr,Mg)_3Si_2O_7$:Pb (peak at 372 nm), or $SrB_4O_7$:Eu (peak at 386 nm). The phosphor layer 63 may be thicker on the face 32 in order to increase the illumination.

A soda-lime-silica glass, such as Planilux® sold by Saint-Gobain, is chosen at least for the plate 3, and preferably for both plates 2, 3, which glass gives a UVA transmission at around 350 nm of greater than 80% for low cost. Its expansion coefficient is about $90 \cdot 10^{-8} K^{-1}$.

The first and second electrodes 41*c*, 51*c* are covered with an electrical insulator 14*c*. The positions of the electrodes 41*c*, 51*c* relative to the glass plate 2 may be varied and as described in the case of the electrodes 41*a*, 51*a* of the first embodiment.

The third electrodes 42*c* form a plurality of bands complementary to the first and second electrodes 41*c*, 51*c*. The face emitting the UV radiation, i.e. the face bearing the third electrodes, is grounded for guaranteeing electrical safety.

All the electrodes 41*c* to 51*c* are bands of silver, for example deposited by screen printing, or bands of copper adhesively bonded to the face 21, 31. These materials are relatively opaque to UV and consequently the ratio of I2 to d3 is adapted so as to increase the overall UV transmission.

For example, this ratio of I2 to d3 is about 20% or less, for example the width I2 is equal to 4 mm and d3 is equal to 2 cm, each third electrode 42*c* being centered on an interelectrode space.

Complementarily, the width I1 is equal to 2 cm and the width d1 is equal to 4 mm.

It is also possible to choose as electrode material a transparent conducting layer of the $SnO_2$:F type, which is less opaque above 360 nm.

Furthermore, as a variant, the electrodes could be in the form of conducting arrays, the pitch and/or the width of which are adapted for overall UV transmission and to do so preferably according to the width chosen for the electrodes. These arrays may be in the form of grids of conducting wires placed in the associated glass plate 2, 3.

It is also possible to choose as electrode material a UV-transparent material so as for example to choose broad bands with a short distance between electrodes on the side facing the emitting face.

The arrangements of the electrodes 41*c*, 51*c* and of the third electrodes 42*c* relative to the associated glass plates 2, 3 may be different, for example they may be placed on the external face 21 and internal face 32 respectively, or vice versa.

Thus, it is possible to reverse the supplies and therefore the amplitudes V3, V03. The third electrodes may then also be combined into a coating covering the face 31, that are coated or not, especially made of aluminum in order to reflect the UV.

In a first variant, a gadolinium-based phosphor is chosen and, at least in the case of the plate 3, a borosilicate glass (with an expansion coefficient of about $32 \cdot 10^{-8} K^{-1}$) or a soda-lime-silica glass containing less than 0.05 $Fe_2O_3$, and also a rare gas such as xenon by itself or as a mixture with argon and/or neon.

In a second variant, in order to obtain a UVC lamp, the phosphors are omitted and either fused silica or quartz is chosen, at least for the plate 3. The gas may be a mixture of rare gases and halogens—or of diatomic halogen or even mercury—for UVC radiation preferably between 250 and 260 nm, for a germicide effect used in particular for disinfecting/sterilizing air, water or surfaces. For example, mention may be made of $Cl_2$ or of XeI or KrF mixture.

In a third variant, in order to obtain a VUV lamp, the phosphors are omitted and high-purity fused silica is chosen at least for the plate 3.

In a fourth variant, in order to obtain a lamp illuminating in the visible, phosphors emitting in the visible are chosen. In this configuration, the lamp illuminates via two faces 21, 31. Differentiated illumination is obtained owing to the different overall transmission between the two faces.

Figure 4:
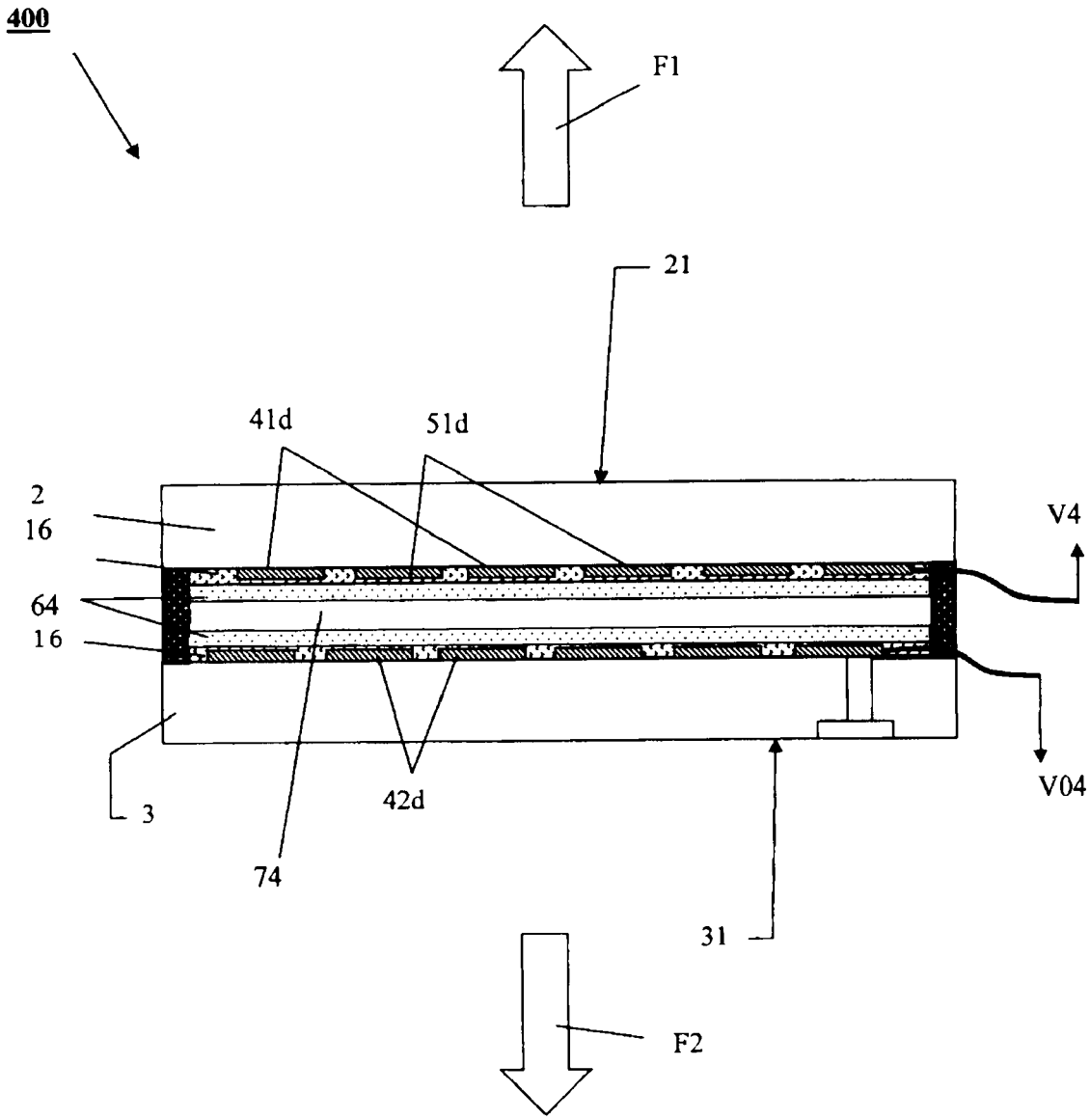
FIG. 4 shows schematically a sectional view of a flat coplanar-discharge lamp according to a fourth embodiment of the invention.

In the embodiment shown in FIG. 4, the structure 400 of the flat coplanar-discharge lamp again has the structure of FIG. 1 except for the elements detailed below. For the sake of clarity, the spacers have not been shown.

This lamp emits white light via the two faces 21, 31 (the light being symbolized by the arrows F1, F2) and may be used as a lamp for decorative or architectural illumination.

Moreover, the first and second electrodes 41*d*, 51*d*, on the one hand and the third electrode 42*d* on the other are deposited directly on the internal face 22, 32 and coated with a transparent dielectric material, such as a glass frit.

The widths I1 and I2 of the electrodes 41*d*, 51*d*, 42*d* are identical, typically 6 cm. These widths I1 and 12 are greater than the width d1, for example 5 times greater. The sum I1+d1 is equal to the sum I2+d3.

The third electrodes 42*d* are preferably arranged so that each interelectrode space is full. Here, the edge of a third electrode forms, in projection, a continuity with the edge of a first or of a second electrode. Alternatively, each third electrode is centered with respect to the associated interelectrode space.

The positions of the electrodes 41*d*, 51*d*, 42*d* relative to the associated glass plates 2, 3, and their nature, may be various, as described in the case of the electrodes 41*a*, 51*a* of the first embodiment.

The arrangement of the electrodes 41*d*, 51*d*, 42*d* and of the third electrodes 42*d* may be different, for example the third electrodes are incorporated into the glass plate 3 or are on the external face 31.

Finally, the third electrode 42*d* is supplied with DC voltage V04 chosen to be 100V or 0V.

The amplitude V4 of the sinusoidal signal is reduced to 500V, as there is less loss at the terminals of the thinner dielectric.

Figure 5:
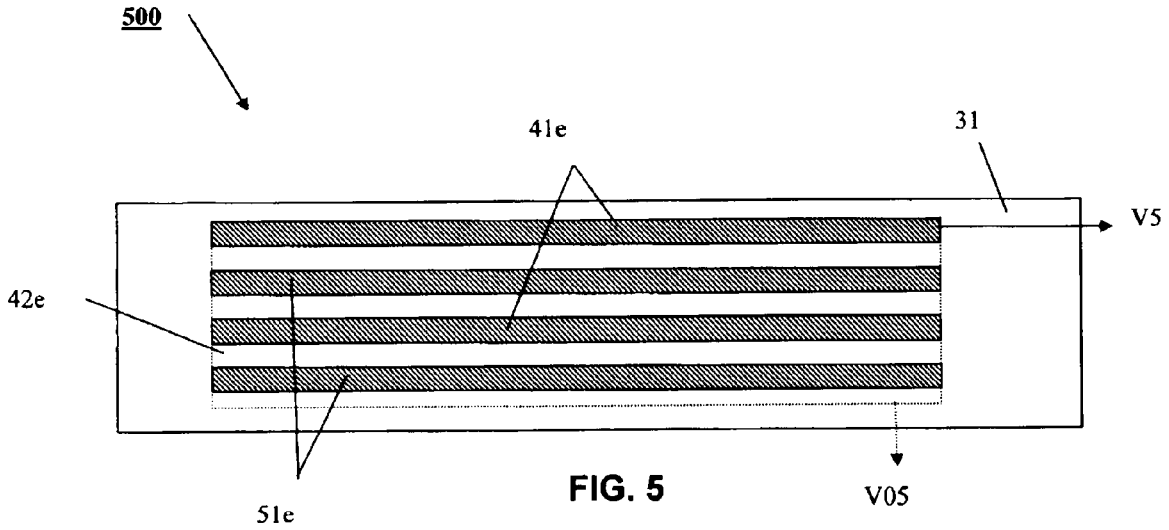
FIG. 5 shows schematically a topview of a flat coplanar-discharge lamp according to a fifth embodiment of the invention.

In the embodiment shown in FIG. 5, the structure 500 of the flat coplanar-discharge lamp again has the structure of FIG. 2, except for the elements detailed below.

The glass plates are rectangular and the gas is for example a xenon/neon mixture.

The first and second electrodes 41*e*, 51*e* are in the form of longitudinal bands placed on the external face 21. The third electrode 42*e* (shown by the dotted lines) forms a single rectangular band covering substantially the entire face 32.

Furthermore, the electrodes 41*e*, 51*e* have a width I1 of 5 cm, this width being equal to the width of the interelectrode space d1.

The electrodes 41 to 52*e* are made of a transparent conductor such as $SnO_2$:F, which may also have a solar-control and/or low-emissivity function, the lamp performing an illuminating glazing element. The internal faces 21, 31 are covered with a phosphor.

The lamp 500 may also serve as a refrigerator shelf or luminous rack.

Several lamps similar to this lamp 500 may be combined, for example to form a ceiling, the third electrode then being preferably made of a reflecting material, such as aluminum.

Figure 6:
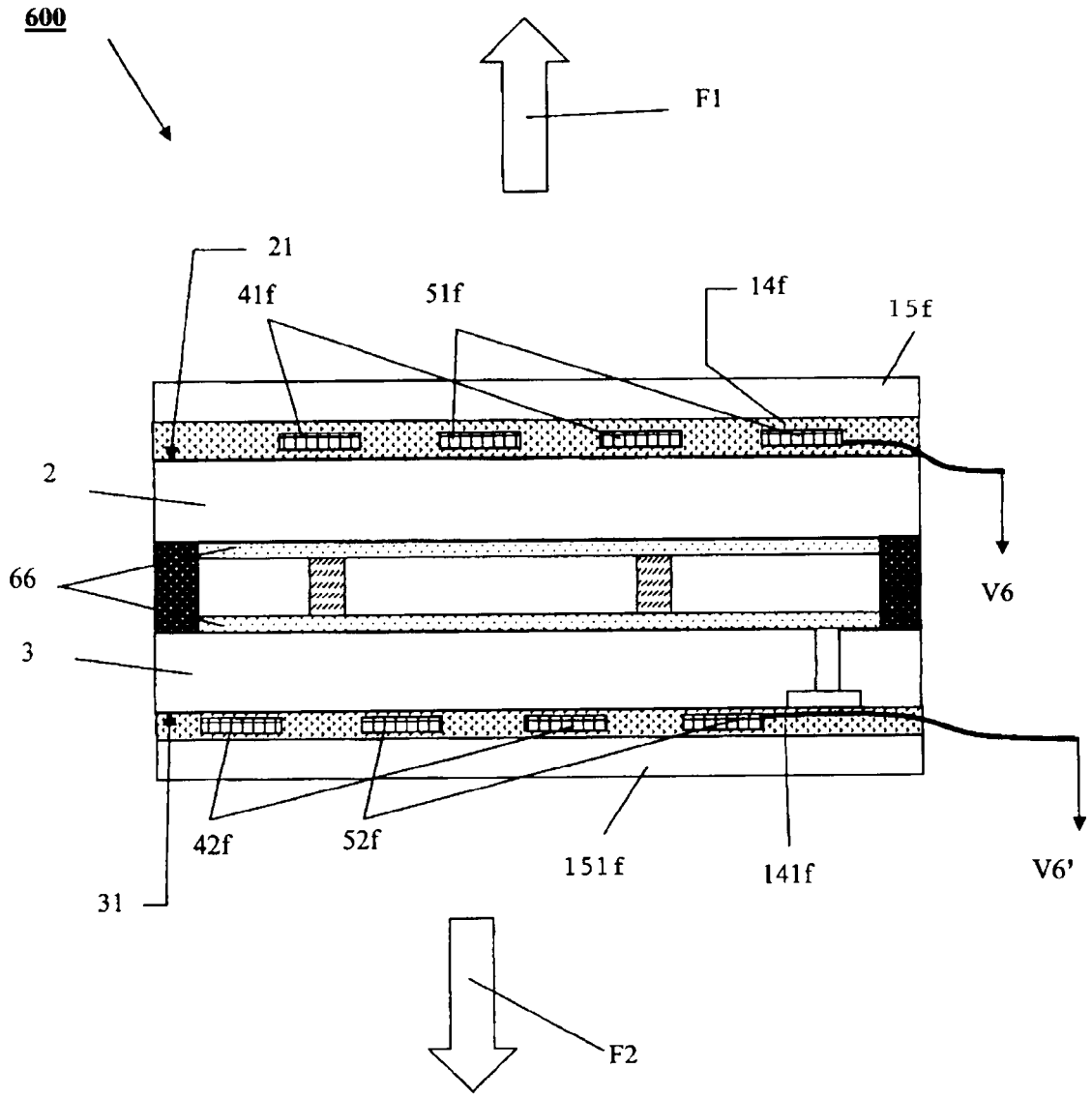
FIG. 6 shows schematically a sectional view of a flat coplanar-discharge lamp according to a sixth embodiment of the invention.

In the embodiment shown in FIG. 6, the structure 600 of the flat coplanar-discharge lamp again has the structure of FIG. 1 except for the elements detailed below.

This lamp 600 emits white light via the two faces 21, 31 (the light being shown symbolically by the arrows F1, F2) and may be used as decorative or architectural illumination, or else as luminous panels, refrigerator shelves, showcases or illuminating windows.

This lamp 600 comprises a plurality of third electrodes 42*f*, 52*f* which are in the form of mutually parallel bands parallel to the edge of the plate 3 and placed on the external face 31.

Also placed on the external face 31 are fourth electrodes 52*f* consisting of mutually parallel bands, which are also parallel to the third electrodes and coupled pairwise with third electrodes 42*f*.

More precisely, the first to fourth electrodes 41*f* to 52*f* are in the form of arrays of conducting wires incorporated into a lamination interlayer 14*f*, 141*f* for joining to a back glass plate 15*f*, 151*f*.

The pitch p1 is for example equal to 3 mm and the width I4 about 20 μm.

The positions of the electrodes 41*f*, 51*f*, 42*f*, 52*f* relative to the associated glass plates 2, 3 may be various, as described in the case of the electrodes 41*a*, 51*a* of the first embodiment. The positions of the electrodes 41*f*, 51*f* and of the third and fourth electrodes 42*f*, 52*f* relative to the associated glass plates 2, 3 may be different.

The widths I1, I2 of the electrodes 41*f* to 52*f* are chosen to be identical, typically equal to 4 cm. These widths are furthermore chosen to be equal to the widths d1 and d2.

The third and fourth electrodes 42*f*, 52*f* are preferably placed so that each interelectrode space between first and second electrodes is filled. These electrodes 42*f*, 52*f* are also centered with respect to the first and second electrodes 41*f*, 51*f*.

The first and second electrodes 41*a*, 51*a* on the one hand and the third and fourth electrodes 42*f*, 52*f* on the other hand are supplied with a sinusoidal signal, preferably of identical or similar amplitude V6, V6' of about 1500V and at 20 kHz.

This lamp 600 is a double coplanar-discharge lamp. This is because it produces a coplanar discharge between each pair of electrodes 41*f*, 51*f* on the one hand and 42*f*, 52*f* on the other.

Of course, a control system may be provided, in order to vary the amplitude and therefore the illumination, or an independent supply may even be provided for the two discharges.

Each discharge is made homogeneous and the lamp 600 also has excellent performance in terms of luminance and luminous efficiency.

The pressure of the gas is chosen to be 200 mbar and the illuminating area 30 cm by 30 cm. The luminance reaches 1500 $Cd/m^2$ and the luminous efficiency 35 lm/W.

In a variant, the pressure is equal to 100 mbar and the signal is a pulsed signal with a duty cycle of 10% and a frequency of 40 kHz. For widths of 4, 5 or 6 cm, a luminance of 1400

Cd/m$^2$, 1300 Cd/m$^2$ and 1500 Cd/m$^2$ and a luminous efficiency of 301 m/W, 401 m/W and 451 m/W are obtained, respectively.

The phosphor 66 covers substantially each entire internal face 22, 32. In a variant, only part of the internal faces 22, 32 may be coated with the phosphor material. Thus, even if the electrodes cause discharges throughout the volume of the lamp, a differentiated distribution of the phosphor in certain regions makes it possible to convert the energy of the plasma into visible radiation only in the regions in question, so as to constitute juxtaposed illuminating regions and transparent regions. These regions may also possibly constitute decorative features or constitute a display, such as a logo or a trademark.

Figure 7:
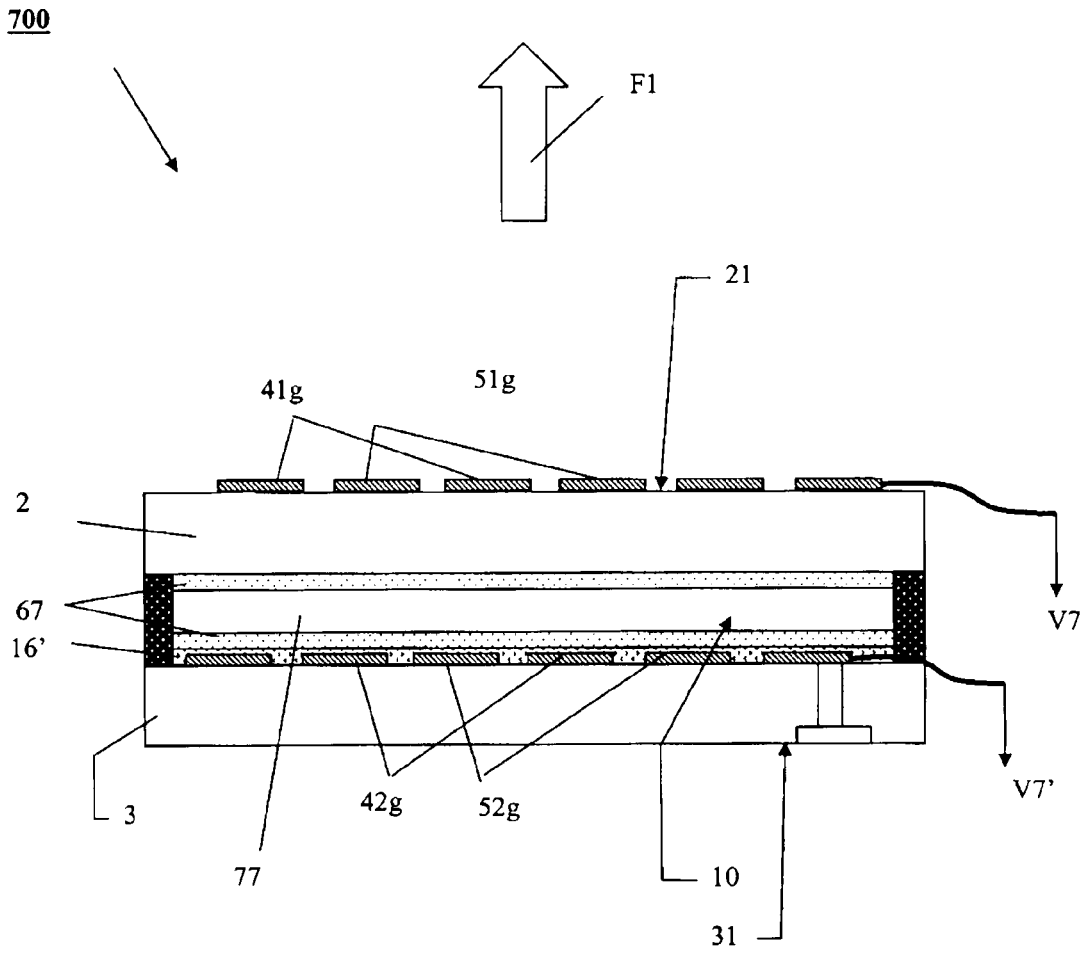
FIG. 7 shows schematically a sectional view of a flat coplanar-discharge lamp according to a seventh embodiment of the invention.

In the embodiment shown in FIG. 7, the structure 700 of the flat coplanar-discharge lamp again has the structure of FIG. 6 except for the elements detailed below.

The lamp 700 emits radiation in the visible only via its face 21 (the radiation being symbolized by the arrow F1).

The first and second electrodes 41*g*, 51*g* are deposited directly on the plate 2 and not in a lamination. They consist of transparent films or thin screen-printed bands of silver, or else conducting arrays adapted for correct overall transmission.

The third and fourth electrodes 42*g*, 52*g* are placed on the internal face 32 and covered with an opaque dielectric 16', for example alumina, the phosphor coatings 67 remaining in contact with the gas 77. The phosphor may be thicker on the face 32 in order to increase the illumination.

The widths I1 and I2 of the electrodes 41*g*, 51*g*, 42*g*, 52*g* are chosen to be identical, typically 5 cm. The widths d1 and d2 are chosen to be identical. The widths I1 and I2 are greater than the widths d1 and d2, for example 10 times greater.

The third and fourth electrodes 42*g*, 52*g* are arranged so that each interelectrode space is filled. For example the edge of a third or fourth electrode forms, in projection, a continuity with the edge of a first or second electrode. Alternatively, each third or fourth electrode could be centered with respect to the associated interelectrode space.

This lamp may be a device for backlighting a liquid-crystal matrix or an illuminating tile.

Figure 8:
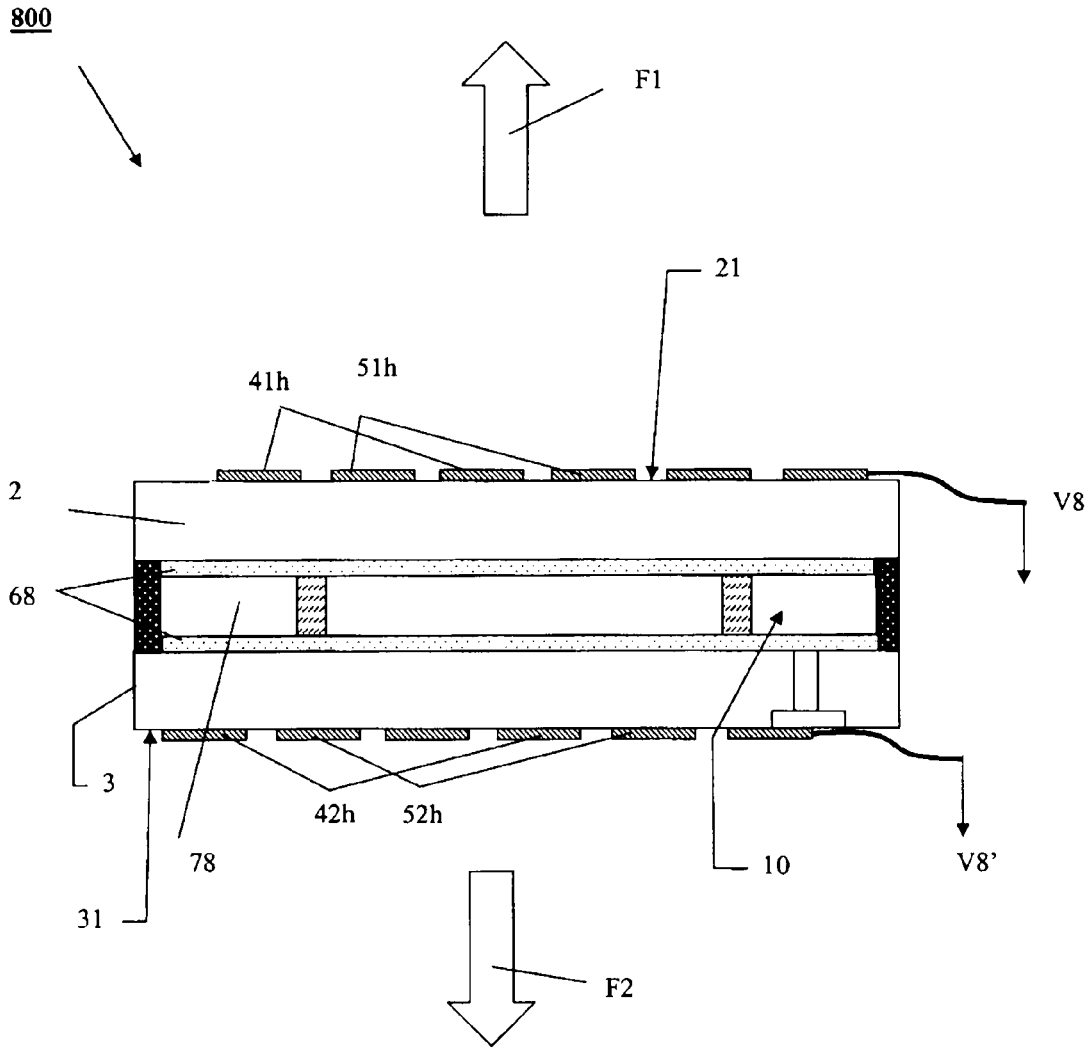
FIG. 8 shows schematically a sectional view of a flat coplanar-discharge lamp according to an eighth embodiment of the invention.

In the embodiment shown in FIG. 8, the structure 800 of the flat coplanar-discharge lamp again has the structure of FIG. 6 except for the elements detailed below.

The widths I1 and I2 of the electrodes 41*h*, 51*h*, 42*h*, 52*h* are chosen to be identical, typically 5 cm, and the widths d1 and d2 are chosen to be identical. The widths I1 and I2 are greater than the widths d1 and d2, for example 10 times greater.

The third and fourth electrodes 42*h*, 52*h* are arranged so that each interelectrode space is filled. For example each third or fourth electrode is centered with respect to the associated interelectrode space.

The phosphor coatings 68 may form indicating elements.

Furthermore, the electrodes 41*h* to 52*h* are made of transparent conducting films and are not in a lamination.

The pressure of the gas is chosen to be equal to 100 mbar, the signal is a pulse signal with a duty cycle of 10% and the frequency is 40 kHz, and the illuminating area is 30 cm by 30 cm.

Alternatively, the edge of a third or fourth electrode forms, in projection, a continuity with the edge of a first or second electrode. The luminance then reaches 2500 Cd/m$^2$, and the luminous efficiency 35 lm/W.

Figure 9:
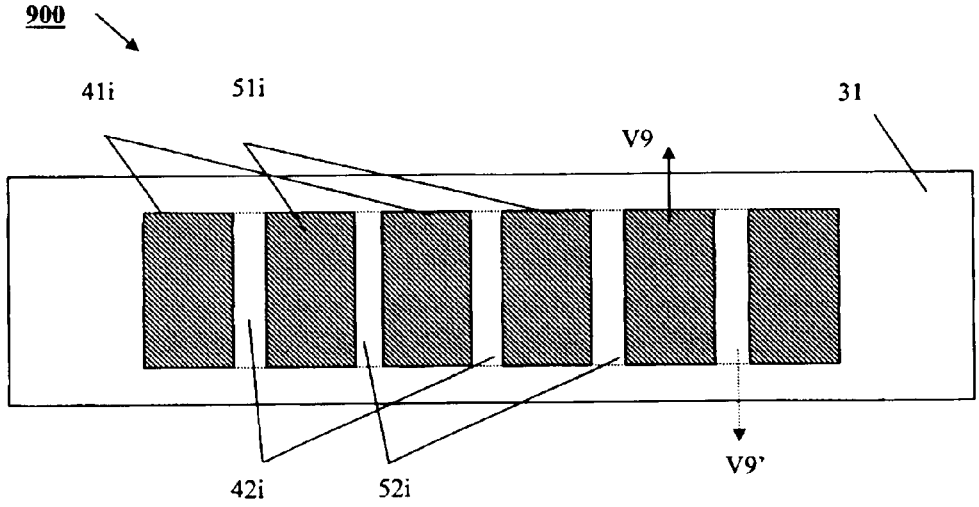
FIG. 9 shows schematically a topview of a flat coplanar-discharge lamp according to a ninth embodiment of the invention.

In the embodiment shown in FIG. 9, the structure 900 of the flat coplanar-discharge lamp again has the structure of FIG. 8, except for the elements detailed below.

The glass plates are rectangular and the electrodes 41*h*, 51*h*, 42*h* are in the form of lateral bands placed on the external faces 21, 31.

Figure 10:
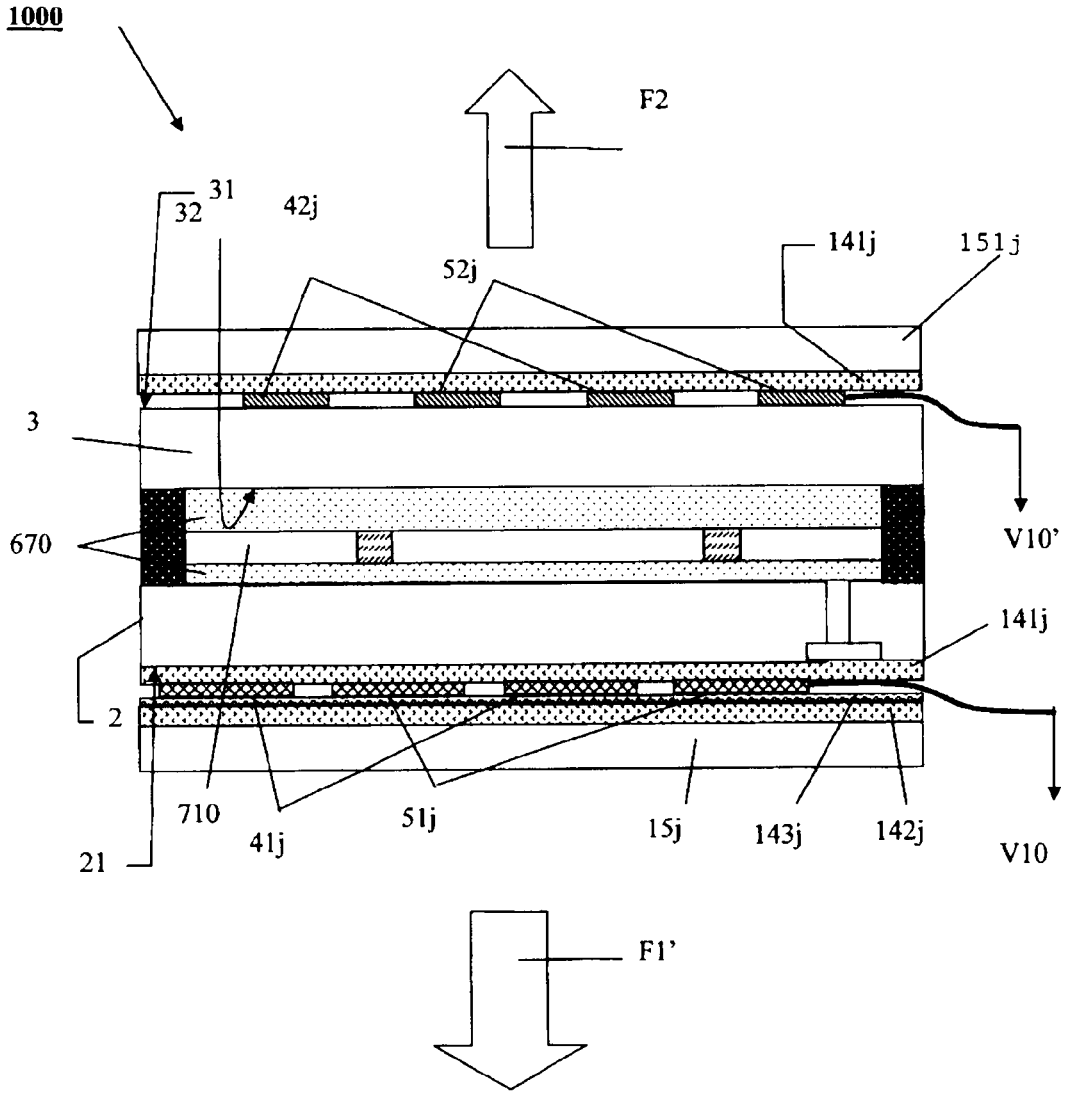
FIG. 10 shows schematically a sectional view of a flat coplanar-discharge lamp according to a tenth embodiment of the invention.

In the embodiment shown in FIG. 10, the structure 1000 of the flat coplanar-discharge lamp again has the structure of FIG. 6 except for the elements detailed below.

This lamp 1000 emits white light via the two faces 21, 31, the illumination being more intense on the same side as the face 21 (the light being symbolized by the arrows F1' and F2, of different widths) and may for example be used as a lamp for decorative or architectural illumination.

The first and second electrodes 41*j*, 51*j* are in the form of arrays of conducting wires and more precisely formed from a first series of mutually parallel wires and a second series of mutually parallel wires perpendicular to the first series, these for example being made of copper. These arrays are carried by a thin plastic of the PET type 143*j* located between two lamination interlayers, of the PVB or PU or EVA type, 141*j*, 142*j*, for joining to the back glass plate 15*j*, 151*j*. The electrodes are for example oriented toward the face 22, 32.

For an optimum overall transmission, a ratio of the width I4 of the wires to the pitch p1 of the wires of 10% or less is chosen, for example with a width I4 of 10 μm and a pitch p1 of 100 μm or more. Furthermore, I1 is equal to 6 cm and d1 is equal to 1 cm.

The first and fourth electrodes 42*j*, 52*j* are silver bands, for example deposited by screen printing, on the face 31 and are located between the lamination interlayer 141*j* and the back glass plate 151*j*. The width I2 is equal to the width d2 in order to guarantee a minimum overall transmission and is equal to about 3.5 cm.

The projections of the third and fourth electrodes 42*j*, 52*j* fill the associated interelectrode spaces and are off-center with respect to these spaces, but they could also be centered.

The phosphor layer 670 is thicker on the side facing the face 31 in order to increase the illumination difference.

The examples that have just been described in no way limit the invention.

The third electrodes of the second, third, fourth and fifth embodiments may be replaced with alternating third and fourth electrodes.

Likewise, the third and fourth electrodes of the sixth, seventh, eight, ninth and tenth embodiments may be replaced with third electrodes at a given potential.

The invention claimed is:

1. A flat discharge lamp transmitting radiation in the ultraviolet or visible spectrum, comprising:

first and second substantially flat glass elements substantially parallel to each other and defining an internal space filled with gas, the first or second glass elements being made of a material that transmits the radiation;

at least one first electrode and at least one second electrode that are supplied with an AC voltage, the first and second electrodes being associated with one or more main faces of the first glass element, the first and second electrodes being elongate and substantially parallel to one another, and forming an interelectrode space of a substantially constant width d1 between each adjacent electrode; and at least one third electrode at a given DC potential, associated with a main face of the second glass element and at least partly occupying, in projection, each interelectrode space, wherein the projection of the third electrode occupies at least 50% of each of the interelectrode spaces wherein the first and second electrodes are made of transparent conducting films or are overall transparent.

2. The flat radiation-transmitting lamp as claimed in claim 1, wherein the first, second, and third electrodes form mutually parallel bands, and wherein the first and second electrodes have a substantially equal width I1, the third electrode has a width I2, and wherein the widths I1 and I2 are substantially equal to each other and equal to the width d1.

3. The flat radiation-transmitting lamp as claimed in claim 1, wherein the first, second, and third electrodes form mutually parallel bands, and wherein the first and second electrodes have a substantially equal width I1, the third electrode has a width I2, the widths I1 and I2 being substantially equal and a ratio I1 to d1 being greater than 1.

4. The flat radiation-transmitting lamp as claimed in claim 1, wherein the first, second, and third electrodes form mutually parallel bands, and wherein the first and second electrodes have a substantially equal width I1, and each third electrode has a width I2 and is separated by at least one other interelectrode space of substantially constant width d3, a sum I1+d1 being substantially equal to a sum I2+d3, I1 being greater than 1 and d1 being less than d3.

5. The flat radiation-transmitting lamp as claimed in claim 1, wherein the third electrode covers substantially the entire the main face of the second glass element.

6. The flat radiation-transmitting lamp as claimed in claim 1, wherein the third electrode has a solar-control or low-emissivity function, or forms an electrode of an optoelectronic element associated with the flat lamp.

7. The flat radiation-transmitting lamp as claimed in claim 1, further comprising at least one fourth electrode associated with a main face of the second elongate glass element and substantially parallel to the third electrode, and wherein the third and fourth electrodes are at different potentials and are supplied with an AC voltage.

8. The flat radiation-transmitting lamp as claimed in claim 7, wherein a projection of the third electrode or of the fourth electrode at least partly occupies the interelectrode spaces.

9. The flat radiation-transmitting lamp as claimed in claim 7, wherein a projection of the third electrode or of the fourth electrode substantially occupies the entire interelectrode spaces.

10. The flat radiation-transmitting lamp as claimed in claim 7, wherein the first, second, third, and fourth electrodes form mutually parallel bands, and wherein the first and second electrodes have a substantially equal width I1 and the third and fourth electrodes have a substantially equal width I2 and are separated by another interelectrode space of width d2.

11. The flat radiation-transmitting lamp as claimed in claim 10, wherein the sum I1+d1 is substantially equal to the sum I2+d2.

12. The flat radiation-transmitting lamp as claimed in claim 10, wherein the widths I1 and I2 are substantially equal to each other and equal to the widths d1 and d2.

13. The flat radiation-transmitting lamp as claimed in claim 10, wherein the widths I1 and I2 are substantially equal, the widths d1 and d2 are substantially equal, and the ratio of I1 to d1 is greater than one.

14. The flat radiation-transmitting lamp as claimed in claim 10, wherein the sum I1+d1 is substantially equal to the sum I2+d2, I1 is greater than I2, and d1 is less than d2.

15. The flat radiation-transmitting lamp as claimed in claim 1, wherein the width of each of the first and second electrodes is equal to 0.5 cm.

16. The flat radiation-transmitting lamp as claimed in claim 1, wherein the projection is centered with respect to the associated interelectrode space.

17. The flat radiation-transmitting lamp as claimed in claim 1, wherein the projection is off-center with respect to the associated interelectrode space.

18. The flat radiation-transmitting lamp as claimed in claim 1, wherein the lamp transmits the radiation via the first and second glass elements.

19. The flat radiation-transmitting lamp as claimed in claim 18, wherein the transmission is differentiated.

20. The flat radiation-transmitting lamp as claimed in claim 1, wherein the first and second electrodes or the third electrode are placed in the internal space.

21. The flat radiation-transmitting lamp as claimed in claim 1, wherein the first and second electrodes or the third electrode are placed outside the internal space and are covered or incorporated, at least partly, in a dielectric element, chosen from the first or the second associated glass element, another glass element, or at least one plastic.

22. The flat radiation-transmitting lamp as claimed in claim 1, wherein the AC voltage is sinusoidal, sinusoidally arched, or pulsed, with a duty cycle of at least 5%.

23. The flat radiation-transmitting lamp as claimed in claim 1, wherein the first and second electrodes or the third electrode are in a form of one or more conducting elongate arrays.

24. The flat radiation-transmitting lamp as claimed in claim 23, wherein the array is defined by a given width I4 of conducting elements and a pitch p1 between the conducting elements is between 5 μm and 2 cm, and the width I4 is between 1 μam and 1 mm.

25. The flat radiation-transmitting lamp as claimed in claim 24, wherein the ratio of the width I4 to the pitch p1 is equal to 50% or less.

26. The flat radiation-transmitting lamp as claimed in claim 1, wherein the third electrode is made of transparent conducting films or are overall transparent.

27. The flat radiation-transmitting lamp as claimed in claim 1, wherein the lamp is configured to be at least one of following parts: an illuminating wall, an illuminating tile, a ceiling, an illuminating glazing unit, an illuminating window, a display or indicating panel, a refrigerator shelf, a luminous rack, a backlighting liquid-crystal screen device.

28. The flat radiation-transmitting lamp as claimed in claim 1, wherein the lamp is configured to be at least one of the following products: a tanning lamp or a surface, air or water sterilizer.

29. A household electrical appliance comprising the lamp as claimed in claim 1.

30. The lamp transmitting radiation in the visible as claimed in claim 1, wherein the lamp is configured to be used for decorative or architectural illumination or for providing a display function.

31. The lamp transmitting UV radiation as claimed in claim 1, wherein the lamp is configured to be used in the following fields: esthetics; electronics; for food; for disinfecting or sterilizing surfaces, air or water, whether tap water, drinking water or swimming pool water; for treatment of surfaces before deposition of active films; for activating a photochemical process of polymerization or cross linking type; for drying paper; for analyses based on fluorescent materials; for activating a photocatalytic material.

32. A flat discharge lamp transmitting radiation in the ultraviolet or visible spectrum, comprising:

first and second substantially flat glass elements substantially parallel to each other and defining an internal space filled with gas, the first or second glass elements being made of a material that transmits the radiation;

at least one first electrode and at least one second electrode that are supplied with an AC voltage, the first and second electrodes being associated with one or more main faces of the first glass element, the first and second electrodes being elongate and substantially parallel to one another, and forming an interelectrode space of a substantially constant width d1 between each adjacent electrode;

at least one third electrode at a given potential, associated with a main face of the second glass element and at least partly occupying, in projection, each interelectrode space; and at least one fourth electrode associated with a main face of the second elongate glass element and substantially parallel to the third electrode, wherein the third and fourth electrodes are at different potentials and are supplied with an AC voltage, wherein projections of the third and fourth electrodes occupy at least 50% of each of the interelectrode spaces wherein the first and second electrodes are made of transparent conducting films or are overall transparent.

* * * * *